US009663262B2

(12) United States Patent
Ballentine et al.

(10) Patent No.: US 9,663,262 B2
(45) Date of Patent: May 30, 2017

(54) COTTON MODULE UNWRAPPING METHOD AND APPARATUS

(71) Applicant: QUEENSLAND COTTON CORPORATION PTY LTD, Newstead (AU)

(72) Inventors: Jeff Ballentine, Newstead (AU); Bobby R. Irons, Watson, AR (US); Steven Ronald Macnellie, Dalby (AU)

(73) Assignee: QUEENSLAND COTTON CORPORATION PTY LTD (AU)

( * ) Notice: Subject to any disclaimer, the term of this patent is extended or adjusted under 35 U.S.C. 154(b) by 20 days.

(21) Appl. No.: 14/347,988

(22) PCT Filed: Sep. 28, 2012

(86) PCT No.: PCT/AU2012/001194
§ 371 (c)(1),
(2) Date: Jun. 16, 2014

(87) PCT Pub. No.: WO2013/044326
PCT Pub. Date: Apr. 4, 2013

(65) Prior Publication Data

US 2014/0363262 A1 Dec. 11, 2014

(30) Foreign Application Priority Data

Sep. 30, 2011 (AU) ..... 2011904038

(51) Int. Cl.
*B65B 69/00* (2006.01)

(52) U.S. Cl.
CPC ..... *B65B 69/0008* (2013.01); *B65B 69/00* (2013.01)

(58) Field of Classification Search
CPC . B65B 69/00; B65B 69/0025; B65B 69/0033; B65B 69/005; B65B 69/0075; B65B 69/0083
(Continued)

(56) References Cited

U.S. PATENT DOCUMENTS 4,466,767 A * 8/1984 Meschi ..... B65B 69/00 414/411
4,548,539 A * 10/1985 Nagashino ..... B65B 69/00 414/403
(Continued)

FOREIGN PATENT DOCUMENTS

SE WO 96/28352 9/1996

OTHER PUBLICATIONS

International Search Report—Dec. 9, 2012.

*Primary Examiner* — Kaitlin Joerger
(74) *Attorney, Agent, or Firm* — Frank J. Dykas; Dykas Law Offices, PLLC

(57) ABSTRACT

A method of, and apparatus for, unwrapping a module of cotton or other fibrous material from a wrapping having at least one layer of plastics-sheet material, the method including the steps of: raising the module to a first, or elevated, position on a lift conveyor or vertically-movable support surface; advancing a plurality of gripper heads, mounted on a support frame, to an advanced position, into gripping engagement with the layer(s) of the sheet material wrapping; lowering the lift conveyor or vertically-movable support surface from the first position towards a second, or lowered, position; and retracting the plurality of gripper heads, to expand the wrapping to progressively release the cotton or other fibrous material from the lower portion to the upper portion of the module.

10 Claims, 17 Drawing Sheets

(58) Field of Classification Search
USPC ..... 414/411, 412, 403, 810
See application file for complete search history.

(56) References Cited

U.S. PATENT DOCUMENTS

| | | | | | |
|---|---|---|---|---|---|
| 4,680,850 | A * | 7/1987 | Boucherie | A46D 1/04 | 29/426.3 |
| 4,681,507 | A * | 7/1987 | Mojden | B65G 59/026 | 414/412 |
| 4,929,141 | A * | 5/1990 | Keesey | B65B 69/0033 | 414/412 |
| 4,988,255 | A * | 1/1991 | Hoffman | B65B 69/00 | 414/412 |
| 5,148,651 | A * | 9/1992 | Masuda | B65B 69/0033 | 53/381.1 |
| 5,318,399 | A * | 6/1994 | Marom | B65B 69/00 | 414/412 |
| 5,371,938 | A * | 12/1994 | Martin | B65B 69/0033 | 29/564.3 |
| 7,165,928 | B2 * | 1/2007 | Haverdink | B65B 69/0033 | 414/303 |
| 2009/0202327 | A1 * | 8/2009 | Cory | B65B 69/0033 | 414/412 |
| 2011/0194918 | A1 * | 8/2011 | Freeman | B65B 69/0033 | 414/412 |
| 2012/0219392 | A1 * | 8/2012 | Leven | D01G 7/12 | 414/411 |

* cited by examiner

DETAIL A

DETAIL A

COTTON MODULE UNWRAPPING METHOD AND APPARATUS

BACKGROUND OF THE INVENTION

1. Field of the Invention

This invention relates to a cotton module unwrapping method and apparatus.

The invention particularly relates, but is not limited to, a method of, and apparatus for, unwrapping round modules, or cylindrical rolls, of cotton wrapped in plastics-sheeting (e.g. polyethylene sheeting).

Throughout the specification, the term "cotton" shall be used to include other natural fibres (e.g. wool and flax) or fibrous materials (e.g. tobacco leaf).

2. Prior Art

Conventionally, harvested cotton has been compressed into large rectangular modules for transport. These rectangular modules require large machines to form the rectangular modules in the field.

Due to the bulk and weight of the rectangular modules, large transport and handling systems are required to transport the rectangular modules to the cotton gin for processing of the cotton.

In recent years, there has been a transition to forming the harvested cotton in round modules (i.e. cylindrical rolls), which are wrapped in several layers of plastics-material (e.g. polyethylene) sheeting. Many cotton farmers are transitioning to round modules to reduce the amount of equipment and seasonal labour required to harvest the crop.

A major limitation with the plastics-sheeting wrapping is that the wrapping is easily damaged and can become a contaminant if introduced to the ginning process.

SUMMARY OF THE PRESENT INVENTION

It is an object of the invention to provide a method for releasing the cotton in a round module, or cylindrical roll, from the surrounding wrapping where the likelihood of the wrapping contaminating the cotton is overcome, or at least ameliorated.

It is a preferred object of the present invention to provide such a method where the release of the cotton in the round module from the wrapping is controlled and conducted in a safe manner.

It is a further preferred object to provide a method where the released wrapping is drawn, or otherwise moved, away from the released cotton.

It is a still further preferred object to provide an unwrapping machine for affecting the unwrapping method.

Other preferred objects will become apparent from the following description.

In one aspect, the present invention resides in a method of unwrapping a (preferably round) module of cotton (or other fibrous material) from a wrapping of at least one layer of (preferably plastics-) sheet material including the steps of:

a) raising the round module to a first (or elevated) position on a lift conveyor (or vertically-movable support surface);

b) advancing a plurality of gripper heads, mounted on a support frame, to an advanced position, into gripping engagement with the layer(s) of the sheet material wrapping;

c) lowering the lift conveyor (or vertically-movable support surface) from the first position towards a second (or lowered) position; and d) retracting the plurality of gripper heads, to expand the wrapping to progressively release the cotton (or other fibrous material) from the lower portion to the upper portion of the round module.

Preferably, the method includes the further step of:

e) as, or after, the lower portion of the cotton is being released from the wrapping, the wrapping is engaged by a discharge apparatus on the support frame for delivery to a waste collection site.

Preferably, the wrapped round module is conveyed to a feed side of the lift conveyor with the central axis of the round module arranged substantially vertically, when the lift conveyor is in the second position.

Preferably, the released cotton falls into a heap or pile on the lift conveyor, and is discharged from a discharge side of the lift conveyor when the lift conveyor has returned to the second position (and is capable of receiving the next round module to be unwrapped).

In a second aspect, the present invention resides in an unwrapping machine for unwrapping at least one layer of (preferably plastics-) sheet material wrapping from a (preferably round) module of cotton (or other fibrous material), the machine including:

a support frame;

a lift conveyor (or vertically-movable support surface), within the support frame;

a lifting mechanism to selectively move the lift conveyor from a first (or raised) position to a second (or lowered) position;

a plurality of gripper heads, the gripper heads being mounted on movable support mechanisms; and the support mechanisms are mounted on the support frame and are operable to selectively advance the gripper heads into engagement with the layer(s) of the sheet material wrapping; so arranged that:

as the lifting mechanism lowers the lift conveyor from the first position to the second position, the support mechanisms retract the gripper heads outwardly towards the support frame to cause the wrapping to be expanded to progressively release the cotton from the lower portion to the upper portion of the round module onto the lift conveyor.

Preferably, a feed conveyor delivers the unwrapped round modules to a feed side of the lift conveyor, when the lift conveyor is in the second position.

Preferably, a discharge conveyor receives the released cotton from a discharge side of the lift conveyor when the lift conveyor has returned to the second position. Preferably, the feed and discharge sides are opposed on the lift conveyor.

Preferably, the lift conveyor has a carriage mounted on substantially-vertical guides on the support frame, the carriage supporting a conveyor belt or conveyor rollers to support the wrapped round module and the released cotton; and a drive mechanism for the conveyor belt or conveyor rollers.

Preferably, the lifting mechanism employs cables and sheaves, or chains and sprockets, or hydraulic- or pneumatic-ram(s), to raise and lower the lift conveyor.

Preferably, the support frame has a plurality of posts or columns, where each column supports a respective support mechanism.

Preferably, each support mechanism incorporates a scissor-arms assembly, or like arrangement, to selectively advance/retract their respective gripper heads in a substantially-vertical orientation.

Preferably, each gripper head has a substantially-vertical engagement face or plate, and a plurality of gripper fingers or spikes extend there-from to engage the wrapping. The fingers or spikes may be selectively retractable behind the engagement face or plate to release the wrapping.

Preferably, a discharge apparatus is provided at, or adjacent, the top of the support frame, and has at least one pair of pinch rollers adapted to engage an upper portion of the wrapping when at least a portion of the cotton has been released from the wrapping, together with a drive mechanism for the pinch rollers.

In a third aspect, the present invention resides in a gripper finger or spike for a gripper head for an unwrapping machine, the gripper finger or spike including:

a shank mountable on the gripper head at an inner end; and a chisel or knife-like cutting portion at the distal end of the shank, the cutting portion being locatable in a cutting position forwardly of the gripper head.

Preferably, the shank is mounted on a support rod in the gripper head and extends co-axially through a hole in an engagement face on the gripper head; and the support rod is optionally mounted for movement between a retracted position, where the cutting portion is rearwardly of the engagement face, and the (extended) cutting position.

BRIEF DESCRIPTION OF THE DRAWINGS

To enable the invention to be fully understood, preferred embodiments will now be described with reference to the accompanying drawings, in which.

NB: Any annotations, dimensions, notes or other descriptive markings, on the drawings are for illustration purposes and to assist the skilled addressee in the understanding of the invention only, and are not limiting to the scope of invention.

DETAILED DESCRIPTION OF THE PREFERRED EMBODIMENTS

FIGS. 1 to 3, 4 and 5, and 6 and 7, respectively, schematically illustrate the three primary stages of the method of unwrapping a round module 10 of cotton C, in accordance with the present invention.

Figure 1:
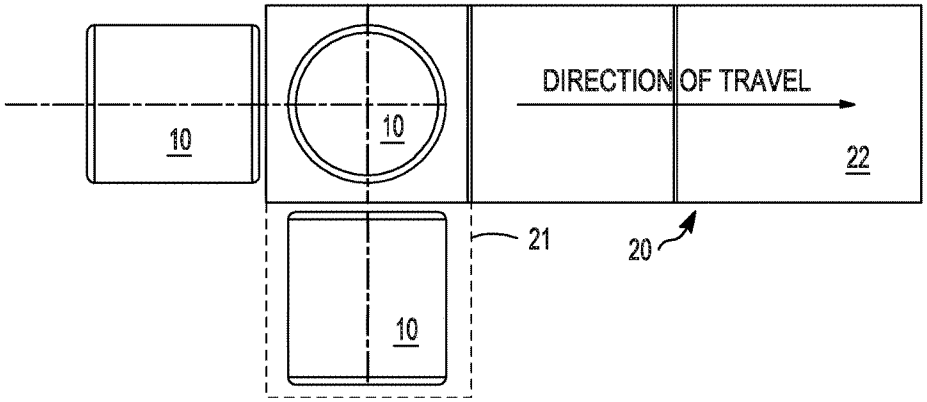
FIG. 1 is a schematic top plan view of a first stage of the unwrapping method of the present invention.
Figure 2:
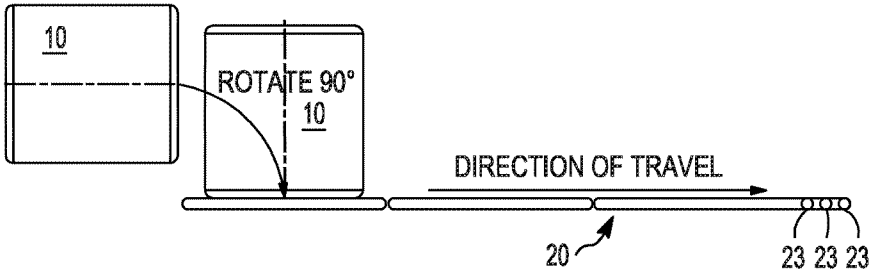
FIG. 2 is a schematic side view of one method of orienting a round module with the feed conveyor.
Figure 3:
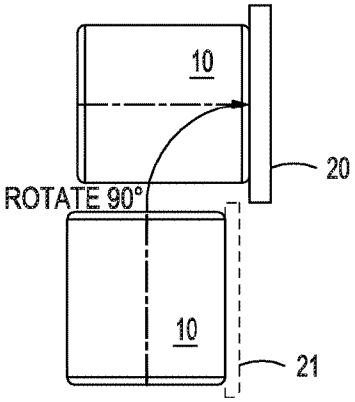
FIG. 3 is a schematic end elevational view of a second method of orienting a round module with the feed conveyor.

In the first stage illustrated in FIGS. 1 to 3, the wrapped round modules 10, e.g. as received from the field, are placed on a feed conveyor 20, the round modules 10 being re-oriented, if necessary, so that the central axes of the round modules 10 are substantially vertical and (preferably) aligned with the center-line of the feed conveyor 20.

Figure 4:
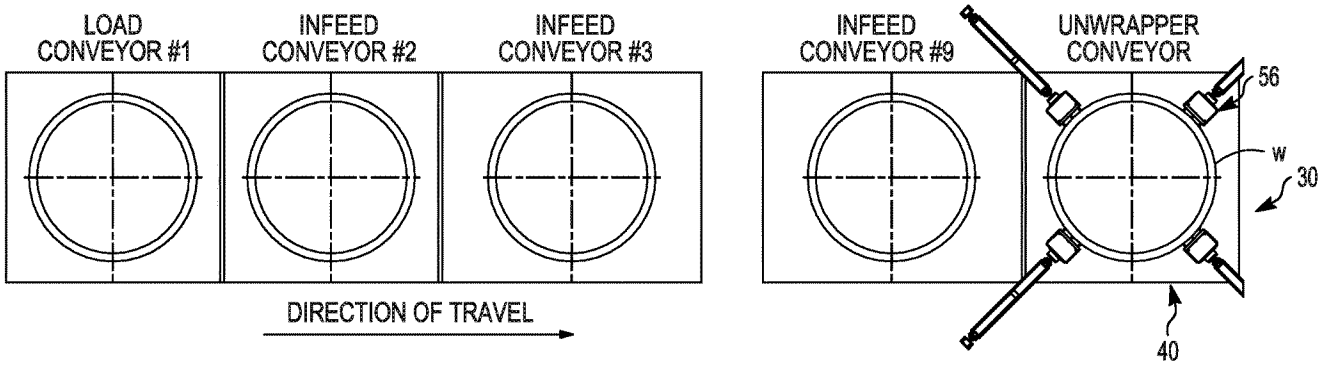
FIG. 4 is a schematic top plan view of the second stage of the unwrapping method.
Figure 5:
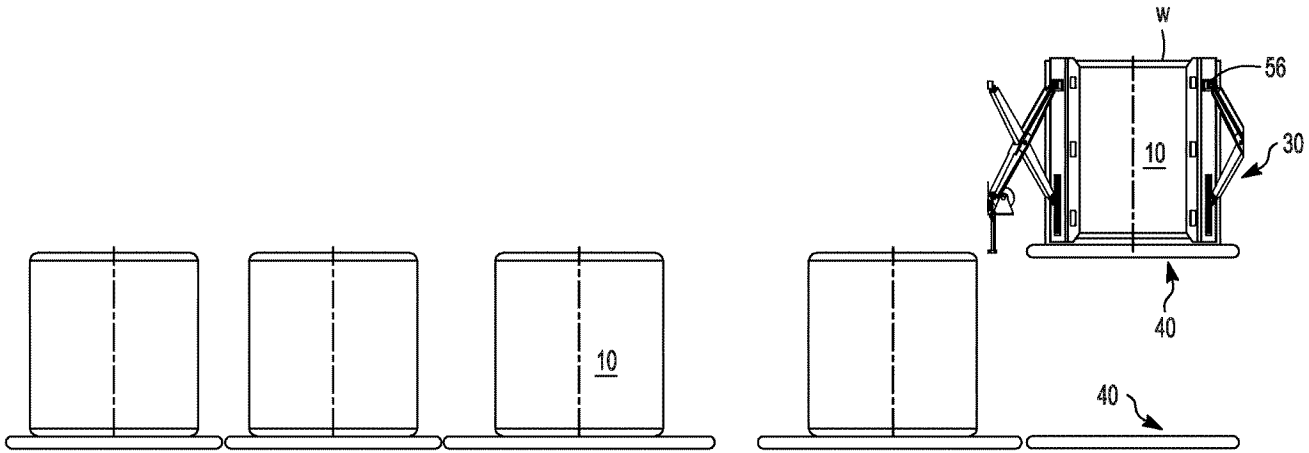
FIG. 5 is a schematic side view corresponding to FIG. 4.

In the second stage, illustrated in FIGS. 4 and 5, the wrapped round modules 10 are advanced into the unwrapping machine 30 sequentially, are raised to an unwrapping position by the lift conveyor 40, and the wrapping W is engaged by the gripper heads 56.

Figure 6:
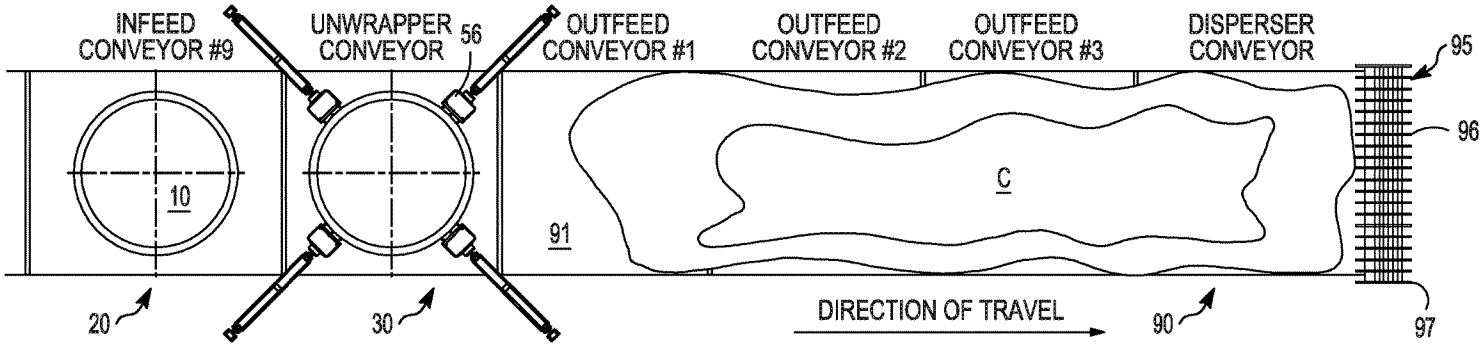
FIG. 6 is a schematic top plan view of the third stage of the unwrapping method.
Figure 7:
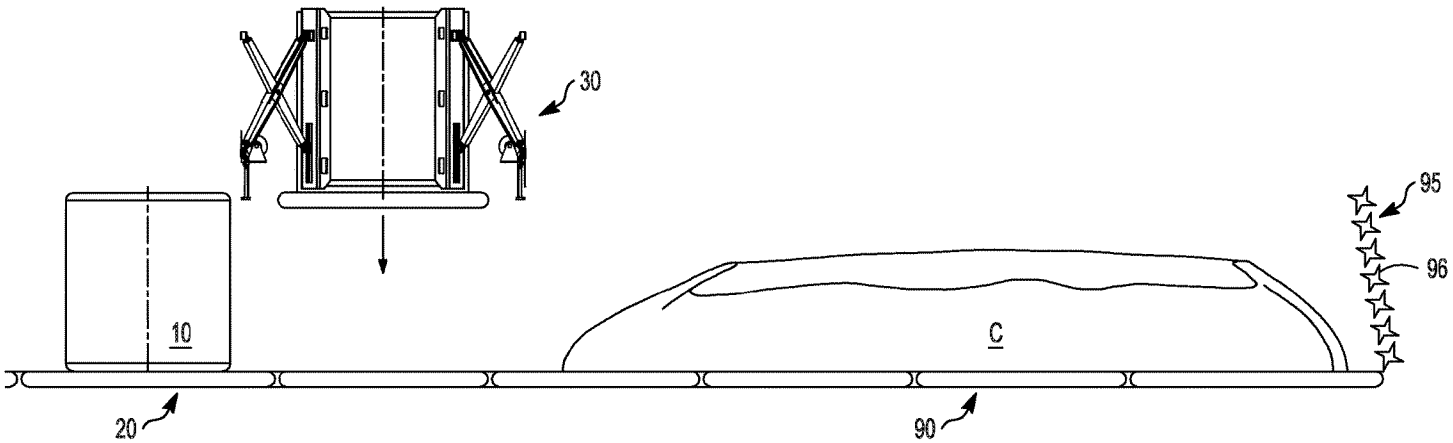
FIG. 7 is a schematic side view corresponding to FIG. 6.

In the third stage illustrated in FIGS. 6 and 7, the lift conveyor 40 is moved downwardly as the gripper heads 56 are retracted outwardly. The cotton C falls from the lower portion of the round module 10 onto the lift conveyor 40. When the lift conveyor 40 is fully lowered, the conveyor belt 41 on the lift conveyor 40 is operated to advance the released cotton C onto the discharge conveyor 90, which transports the pile of cotton C to the disperser conveyor 95 for further processing.

The next wrapped round module 10 is advanced to the lift conveyor 40, and the cycle is repeated.

It will be appreciated by the skilled addressee that the controls for the feed conveyor 20, the unwrapping machine 30, and the discharge conveyor 90 will be linked e.g. by a computer-based system, so that the respective machines 20, 30, 90 operate in the desired operating sequence within the unwrapping cycle.

As illustrated in FIGS. 2 and 3, the unwrapped round modules 10 may not be forwarded to the feed conveyor 20 with the desired orientation. In FIG. 2, where the central axis of the round module 10 is substantially aligned with the longitudinal axis of the feed conveyor 20, but is "laid down" substantially horizontally, the module transporter (not shown) can rotate the round module through 90° to the desired orientation. Alternatively, in FIG. 3, if the central axis of the wrapped round module 10 is transverse to the longitudinal axis of the feed conveyor 20, the module transporter places the round module 10 in a tipping cradle 21, which is raised to deposit the round module 10 on the feed conveyor 20 with the desired orientation.

The feed conveyor 20 may have a conveyor belt 22 to support/advance the round modules 10 to the unwrapping machine 30. Alternatively, the feed conveyor 20 may have a plurality of driven rollers 23, which allow any rubbish adhering to the exterior of the wrapping W to be dislodged and fall to the floor for collection, to minimize potential contamination of the released cotton C.

The discharge conveyor 90 has a conveyor belt 91 to support the heap or pile of loose cotton C received from the lift conveyor and conveys the loose cotton C to the disperser conveyor 95, where the cotton C passes through between substantially star-shaped rotor blades 96 mounted at equal spacing across horizontal drive-shafts 97 journalled in bearings in vertical side plates (not shown).

Figure 8:
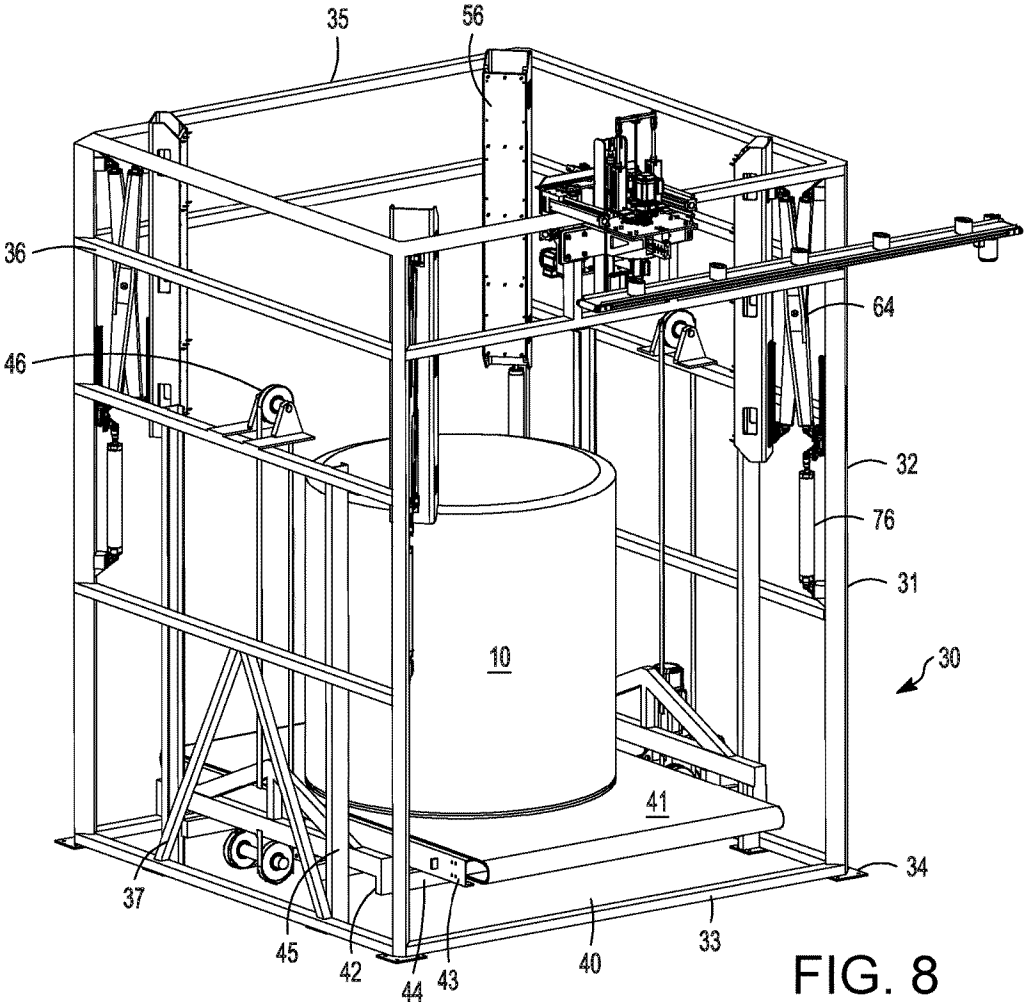
FIG. 8 is a front isometric view of the unwrapping machine with the lift conveyor in a lowered position to receive the round module to be unwrapped.
Figure 9:
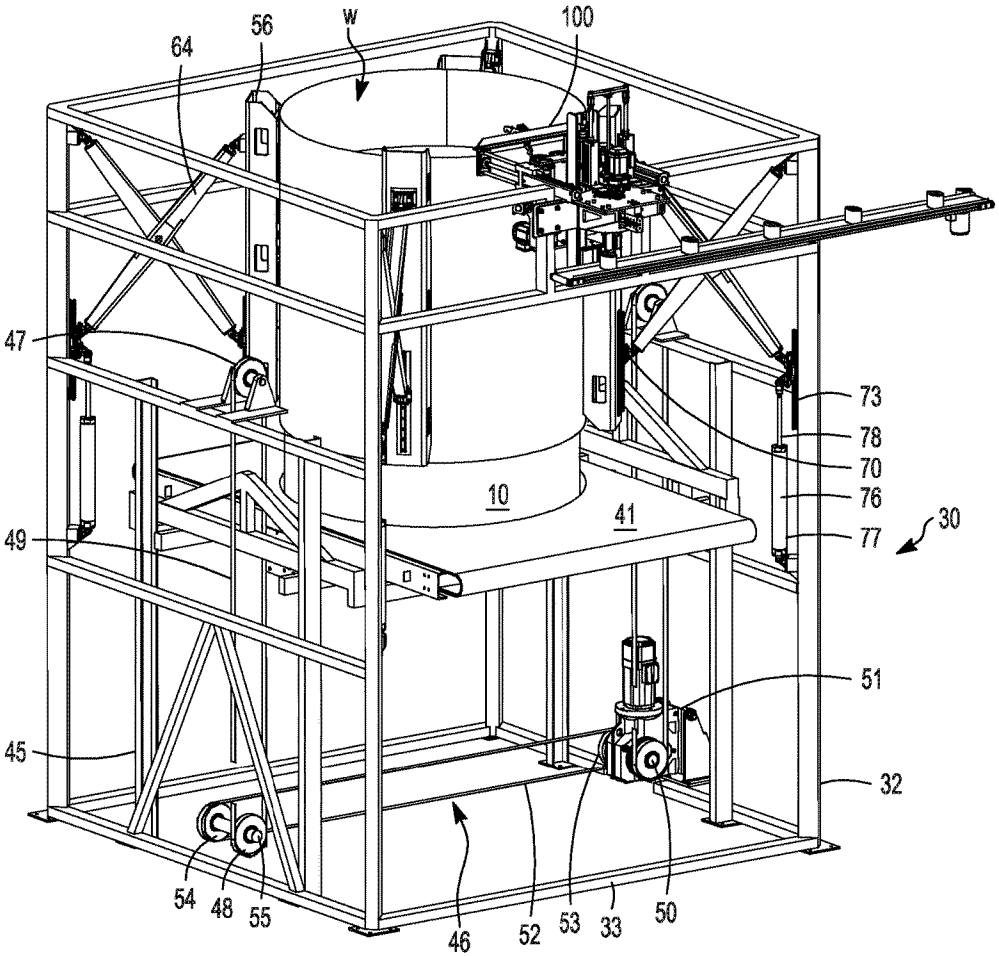
FIG. 9 is a similar view, with the lift conveyor in a raised position, where the round module is partially-unwrapped.
Figure 10:
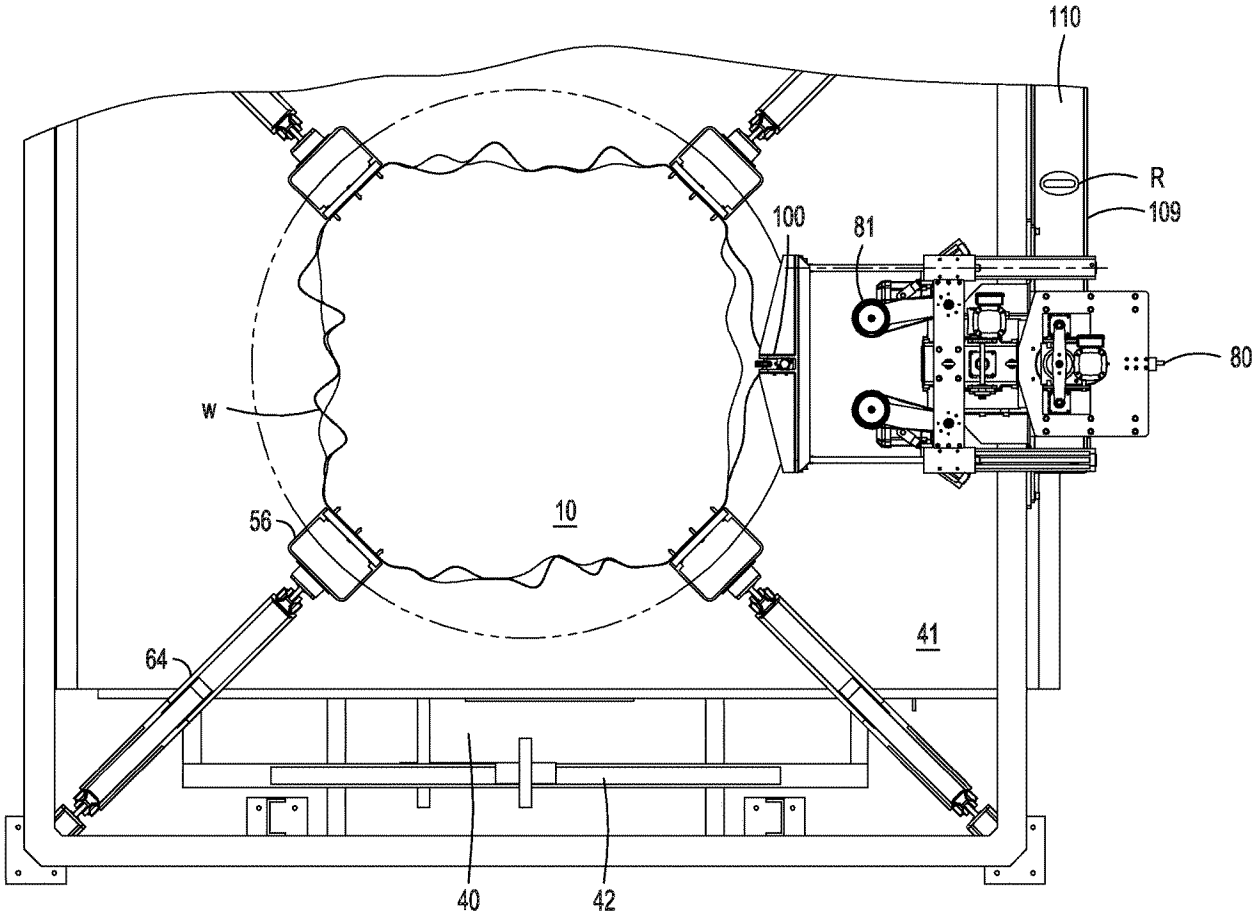
FIG. 10 is a top plan view of the unwrapping machine after the commencement of the unwrapping operation.

Referring to FIGS. 8 and 9, the unwrapping machine 30 has a substantially square support frame 31 in top plan view—see FIG. 10—with vertical columns 32 at respective corners of a base frame 33 anchored to the floor via corner foot-plates 34 and anchor bolts (not shown). The columns 32 connect the base frame 33 to a head frame 35; and the pairs of columns 32, along the opposed sides of the path of the round modules 10/released cotton C, are interconnected by cross-bars 36 and stabilised by angle braces 37.

The lift conveyor 40 has a carriage 42, where parallel rollers (not shown) are journalled in bearings (not shown) in parallel side members 43 of a carriage chassis 44, the rollers supporting the lift conveyor belt 41, and the head and/or tail rollers are selectively driven by an electric- (or pneumatic-) motor (also not shown) to drive the lift conveyor belt 41.

The carriage chassis 44 of the lift conveyor 40 is guided in its vertical path between the lowered- and raised-positions by guide rollers (not shown) which engage vertical guide rails 45 which are mounted on the cross-bars 36 and the base frame 33.

A cable-and-pulley system 46 has respective head-pulleys 47 rotatably mounted on the intermediate cross-bars 36 and tail-pulleys 48 rotatably mounted on the base frame 33. Each pair of head- and tail-pulleys 47, 48 is provided with a lift cable 49 (as a continuous loop) to which is attached the carriage chassis 44. One of the lift cables 49 is driven by the tail-pulley 48 connected to one end of a driveshaft 50 on a lift motor/transmission assembly 51 mounted on the base frame 33. The other lift cable 49 is driven by a driving cable 52 which connects a driving pulley 53, at the other end of the driveshaft 50 on the lift motor/transmission assembly 51, to a driven pulley 54 on a driving shaft 55 to which the tail-pulley 48 is connected. The arrangement of the lift cables 49 ensures that both sides of the carriage chassis 44 are raised/lowered in unison.

As illustrated in FIGS. 8 to 11, 13 to 14, and in more detail in FIGS. 16 to 19, respective gripper heads 56 are mounted on each column 32 of the support frame via respective support mechanisms 64, each incorporating a scissor-arms assembly 65.

Each gripper head 56 has a hollow body 57 with a substantially vertical engagement plate 58 connected to a backing plate 59 by side webs 60. Gripper fingers or spikes 61—see FIG. 19—are mounted on support rods 62 behind the engagement plate 58 and extend through respective holes 63 in the engagement plate 58. (The support rods 62 may be fixed relative to the engagement plate 58; or may be horizontally-movable relatives thereto to enable the gripper fingers or spikes 61 to be retracted so as to not project from the engagement plate 58 on initial engagement with the round module 10.)

The gripper fingers or spikes 61 have chisel or knife-like cutting edges 161, rather than a pointed tip, to cleanly cut the wrapping W. (Conventional pointed spikes tend to rip a hole in the wrapping W, leaving a small piece of plastic stretched over the end of the spike. At some time, the spike releases the piece of plastic in the round module, to thereby inject contamination into the cotton in the round module.)

The support mechanism 64 for each gripper head has a scissor-arms assembly 65, with respective first- and second scissor arms 66, 67.

The first scissor arm 66 has its outer (upper) end hingedly connected to the adjacent column 32 by a hinge assembly 68. The inner (lower) end is hingedly connected to a first traveler 69 slidably mounted on a vertical guide track 70 on the backing plate 59 of the gripper head 56, via a hinge assembly 71.

The second scissor arm 67 has its inner (upper) end hingedly connected to the backing plate 59 of the gripper head 56; and its lower (outer) end hingedly connected to a second traveler 72 slidably mounted on a vertical guide track 73 on the column 32; via similar hinge assemblies 74, 75.

A pneumatic actuator (or ram) 76 has the lower end of a cylinder 77 mounted on the column 32 and the distal end of the piston rod 78 is connected to a bracket 79 at the lower end of the second traveler 72. By extending the pneumatic actuator 76, the scissor arms 66, 67 move the gripper head 56 inwardly towards the centre of the unwrapping machine 30 i.e. away from the column 32.

Referring to FIGS. 10 to 15, the discharge mechanism 80 is mounted on the head frame 34 above the discharge end of the lift conveyor 40.

A pair of pinch rollers 81 has parallel rotational axes spring-mounted on the inwardly-directed portion of the body 82 of the discharge mechanism 80, the pinch rollers 81 being driven by an electric unwrapping motor via a belt-and-pulley drive assembly 83.

A pair of compression rollers 84 are mounted rearwardly (i.e. outwardly) of the pinch rollers 81 and rotate about horizontal axes, the compression rollers 84 being driven by an electric compression drive motor. A lower bag guide roller 86 is mounted forwardly of, and below, the lower of the compression rollers 84. The axle of at least the upper compression roller 84 is journalled in bearings which are vertically movable within the discharge mechanism body 82 and are vertically movable via a compression roller cylinder 87; so that the compression rollers 84 apply a preset minimum compressive force on the unwrapped plastic wrap W as it is drawn away from the cotton C by the pinch and compression rollers 81, 84.

A bag pinch gripper 100, in the form of a hook 101, is hingedly mounted on, and extends inwardly from, a pinch gripper head 102 which can be extended inwardly, or retracted outwardly, by a pneumatic pull back cylinder 103; the bag pinch gripper 100 being able to be swung downwardly into engagement with the adjacent portion of the wrapping W.

A vertical wrap spindle 104 is mounted rearwardly (i.e. outwardly) of the compression rollers 84 to receive the waste wrapping W drawn from the round module 10, and is driven by an electric wrap motor 105.

An RF plastics-welding head 106, with an extendible/retractable welding iron 107, is located adjacent the wrap spindle 104.

A pneumatic eject cylinder 108 vertically moves the wrap spindle 104 from a (raised) wrapping position to a (lowered) discharge position, where a waste roll R comprising one or more wrapped/welded waste wrappings on the wrap spindle 104 is transferred to a transverse waste discharge conveyor 109 for transport to a waste discharge location.

The waste discharge conveyor 109 is mounted on the head frame 34 of the unwrapping machine 30 and has a conveyor belt 110 to support and convey the waste rolls R.

The operational cycle of the unwrapping machine will now be described.

In the lowered position (see FIG. 8), the lift conveyor 40 receives a round module 10 to be unwrapped from the feed conveyor 20, in the correct orientation, as illustrated in FIGS. 4 and 5, where the lift conveyor belt 41 advances the round module 10 to the centre of the carriage 42.

The lift motor/transmission assembly 51 is operated to drive the lift cables 49 to raise the carriage 42 to the raised position—see FIGS. 5 and 9.

The pneumatic actuators 76 for each support mechanism 64 is extended, to cause the scissor arms 66, 67 to advance the gripper heads 56 towards the round module 10 until the engagement plates 58 engage the wrapping W, which is pierced by the gripper fingers or spikes 61. (When the gripper fingers or spikes 61 are movably mounted in each gripper head 56, it is preferable they are retracted as the engagement plates 58 engage the wrapping W, and are then extended into engagement with the wrapping W.)

The bag pinch gripper 100 is also extended and swung down to engage the upper rim of the wrapping W.

The unwrapping step now commences.

Figure 11:
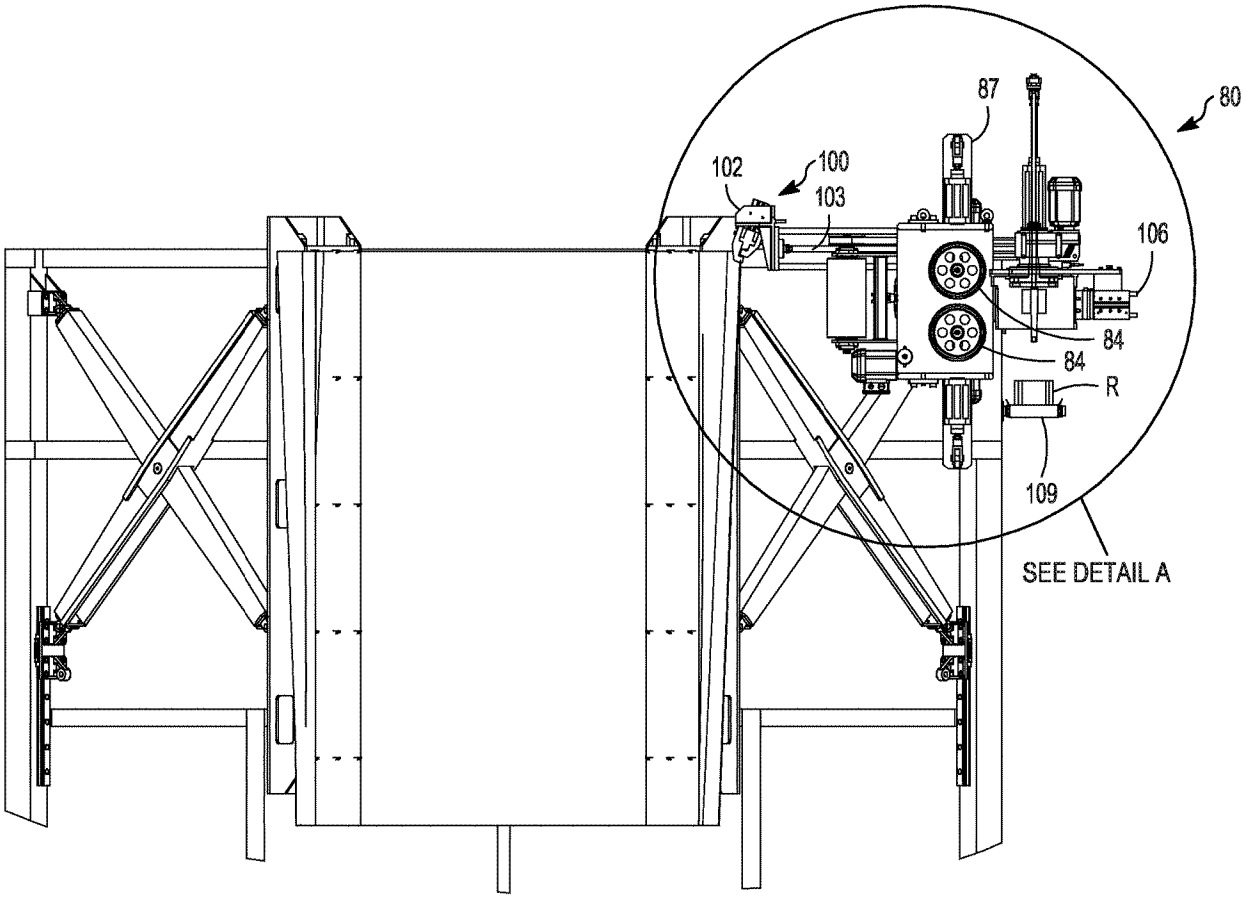
FIG. 11 is a sectional side view taken on line Z-Z on FIG. 10.
Figure 12:
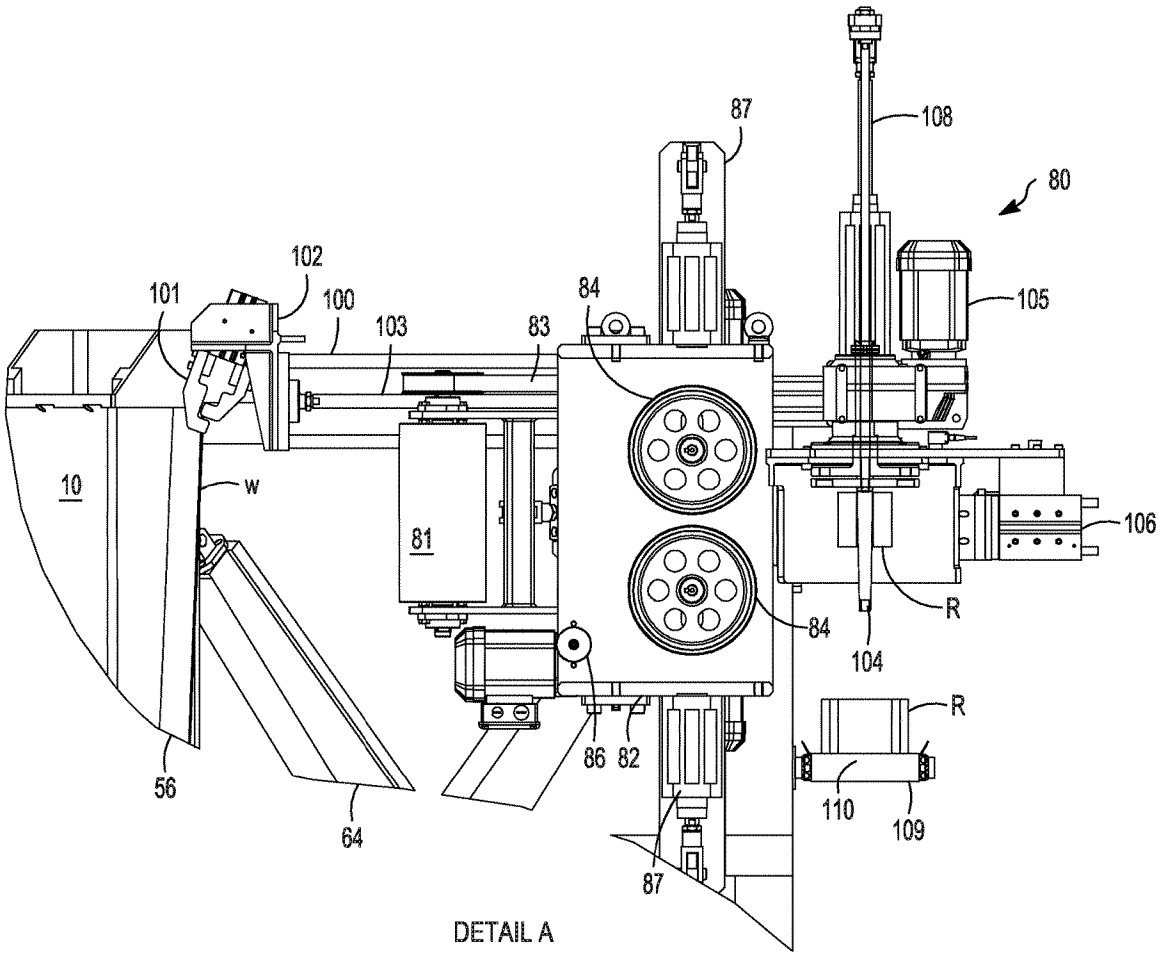
FIG. 12 is an enlarged side view of Detail A on FIG. 11.
Figure 13:
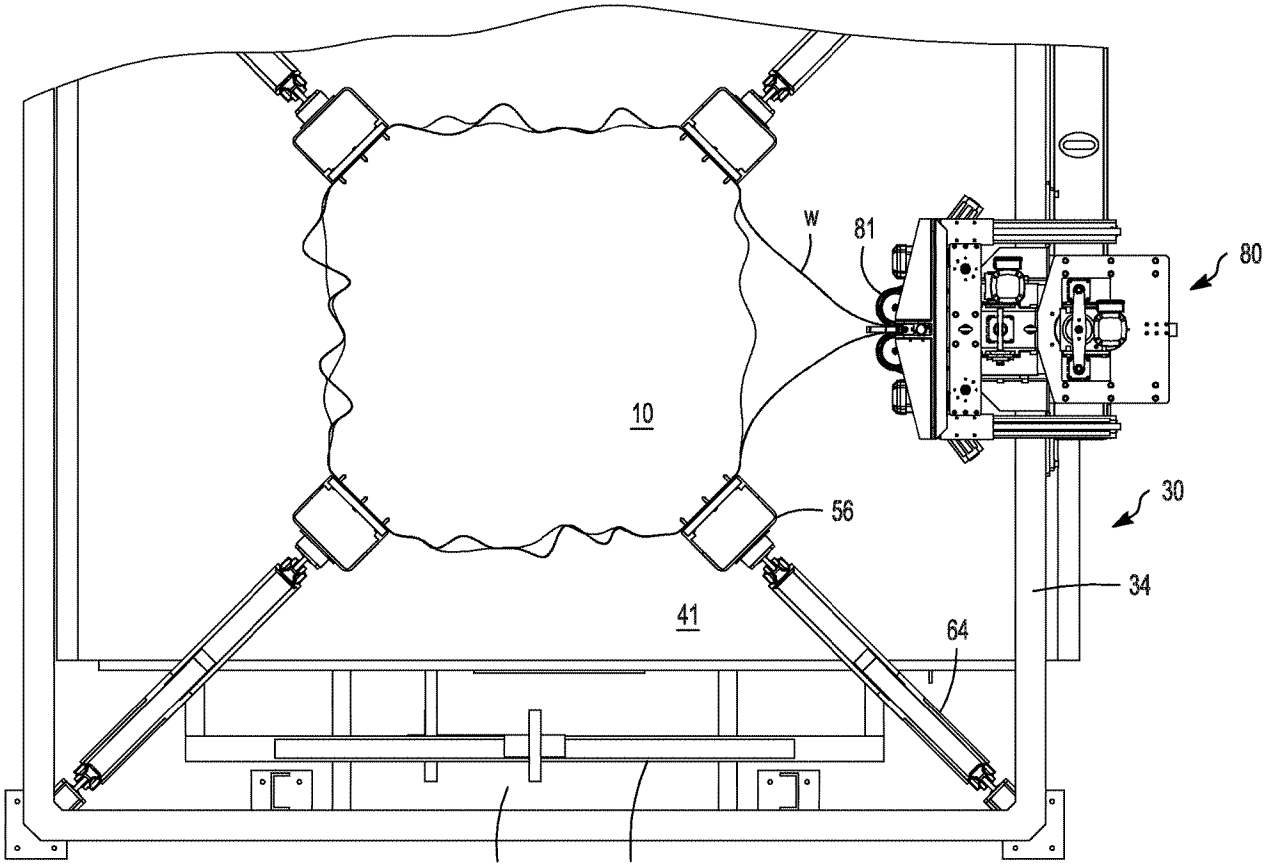
FIG. 13 is a similar view to FIG. 10 after the round module has been unwrapped.
Figure 14:
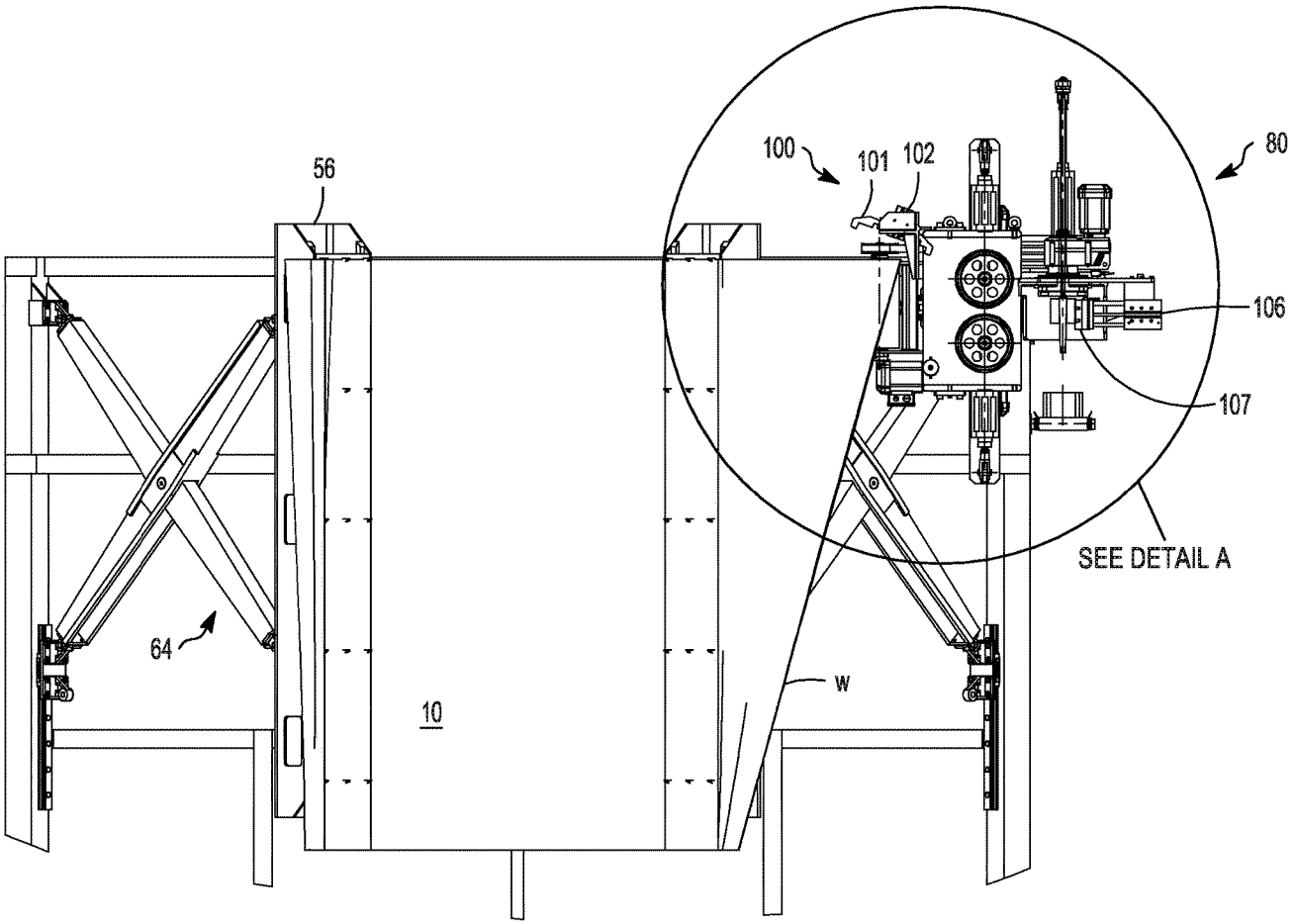
FIG. 14 is a sectional side view taken on line Z-Z on FIG. 13.
Figure 15:
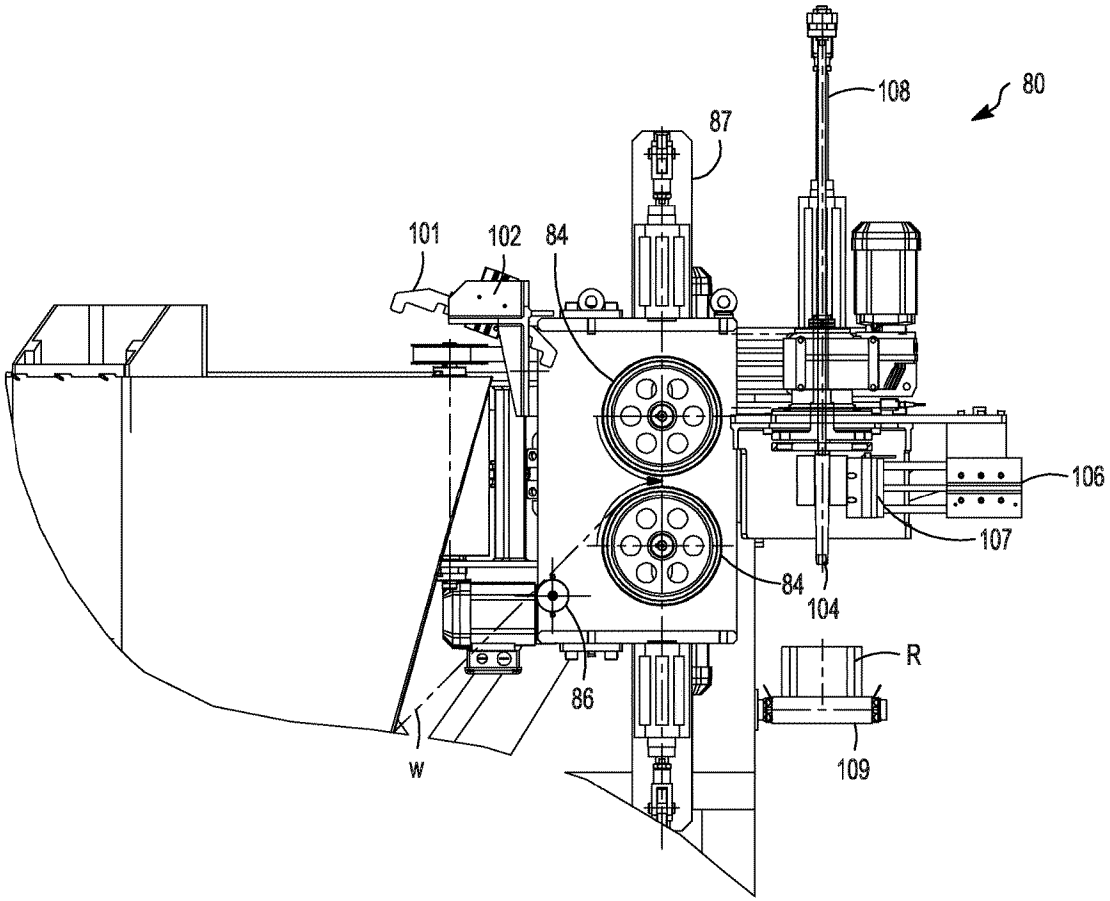
FIG. 15 is an enlarged side view of Detail A on FIG. 14.
Figures 16, 17, 18, 19:
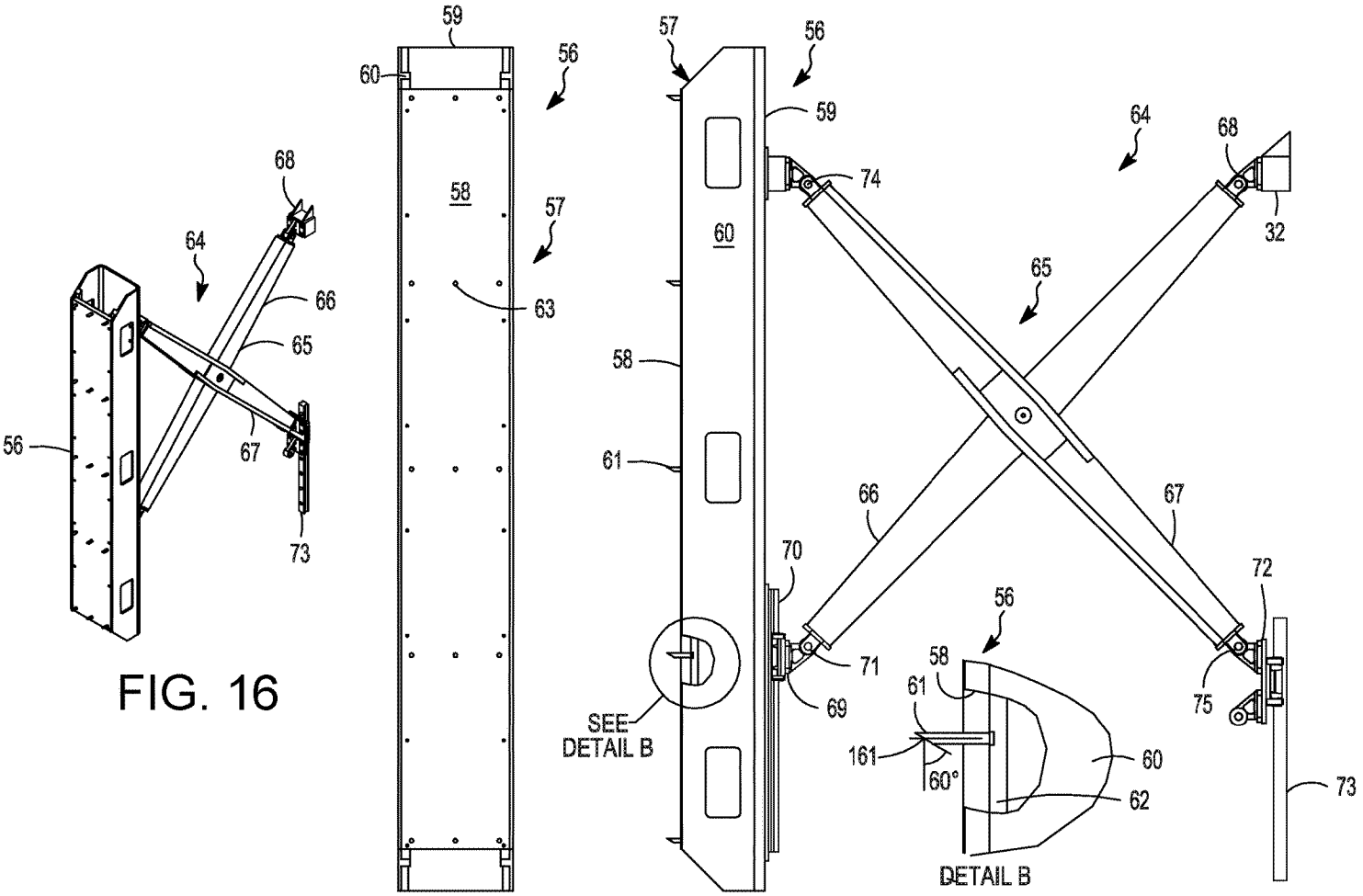
FIG. 16 is a front isometric view one of the scissor arm assemblies and associated gripper head of the machine.
FIG. 17 is a front elevational view of a first embodiment of the gripper head.
FIG. 18 is a side elevational view of the scissor arm assembly and gripper head, with a portion of the gripper head being shown in section on line A-A on FIG. 17.
FIG. 19 is an enlarged side view of Detail B on FIG. 18.
Figure 20:
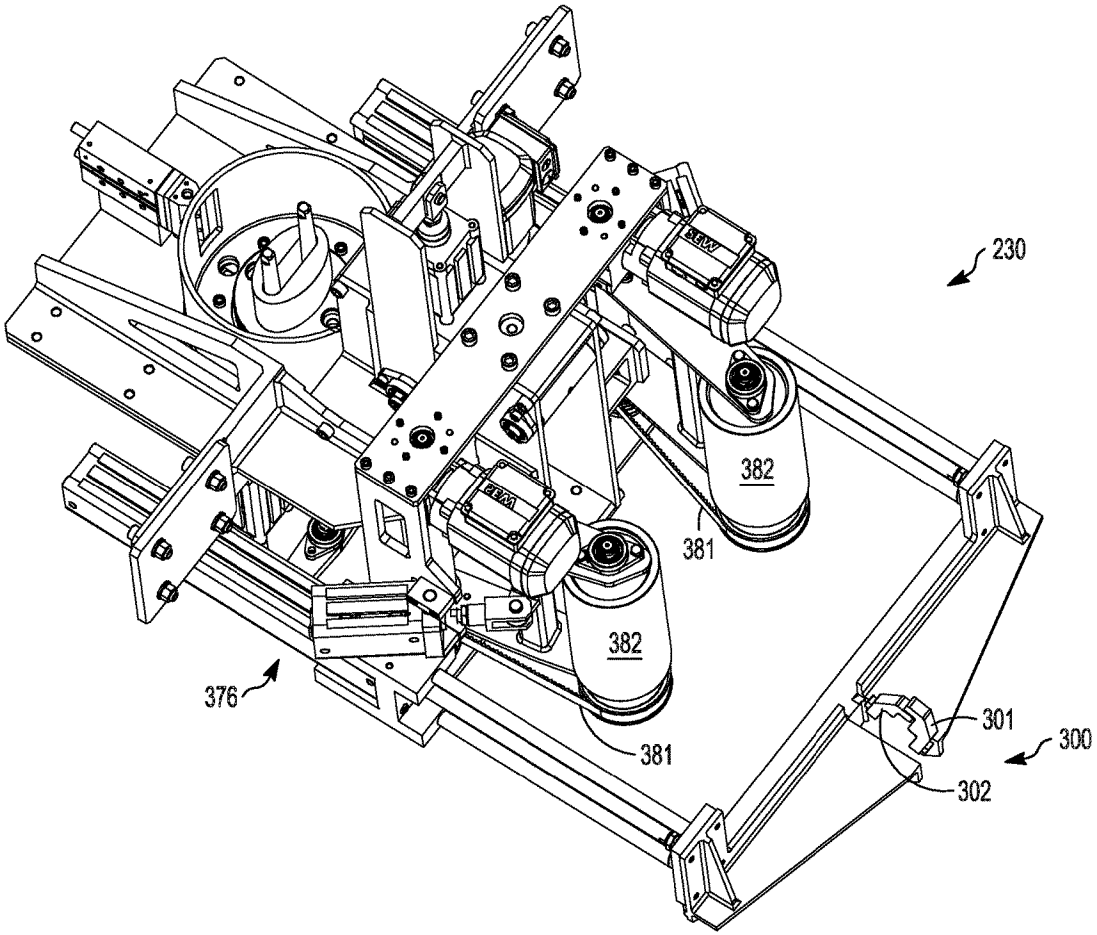
FIG. 20 is an underside front view of a second embodiment of the unwrapping machine.
Figure 21:
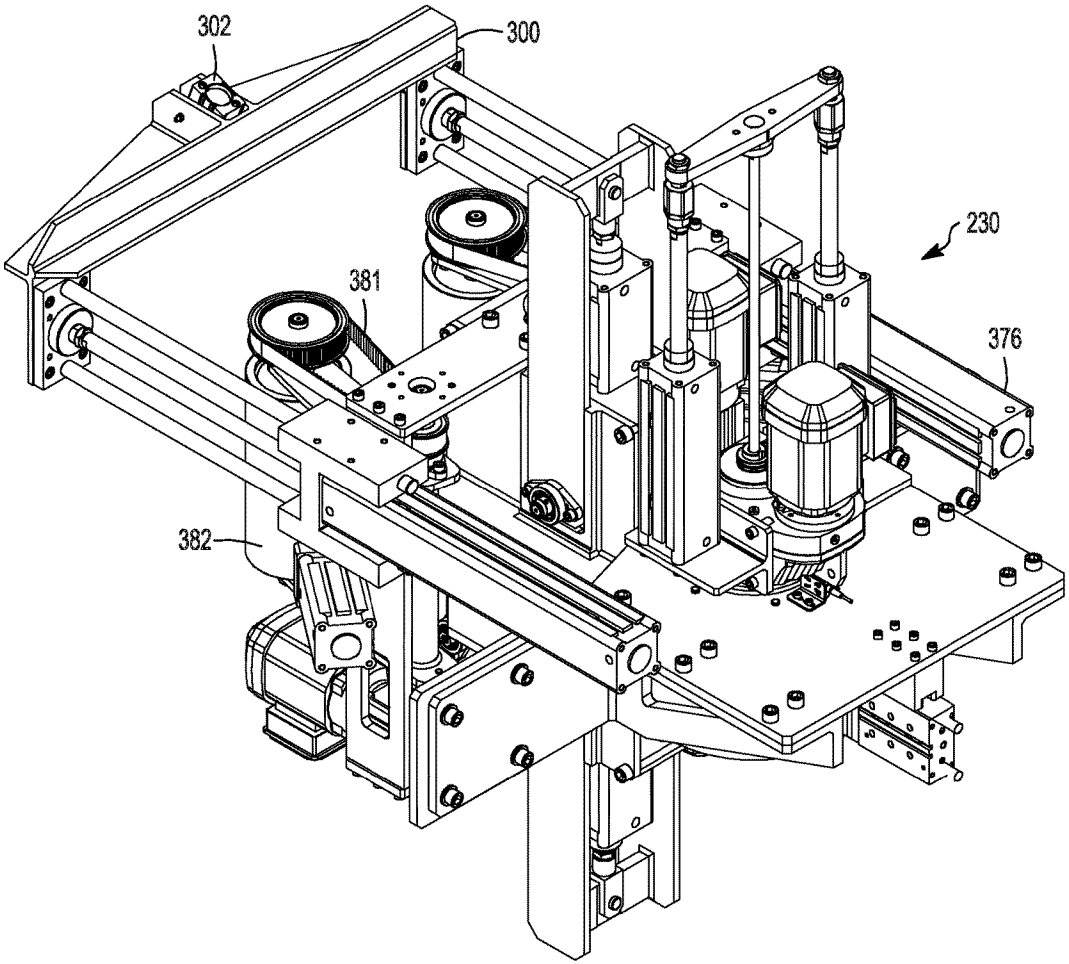
FIG. 21 is a top rear isometric view thereof.
Figure 22:
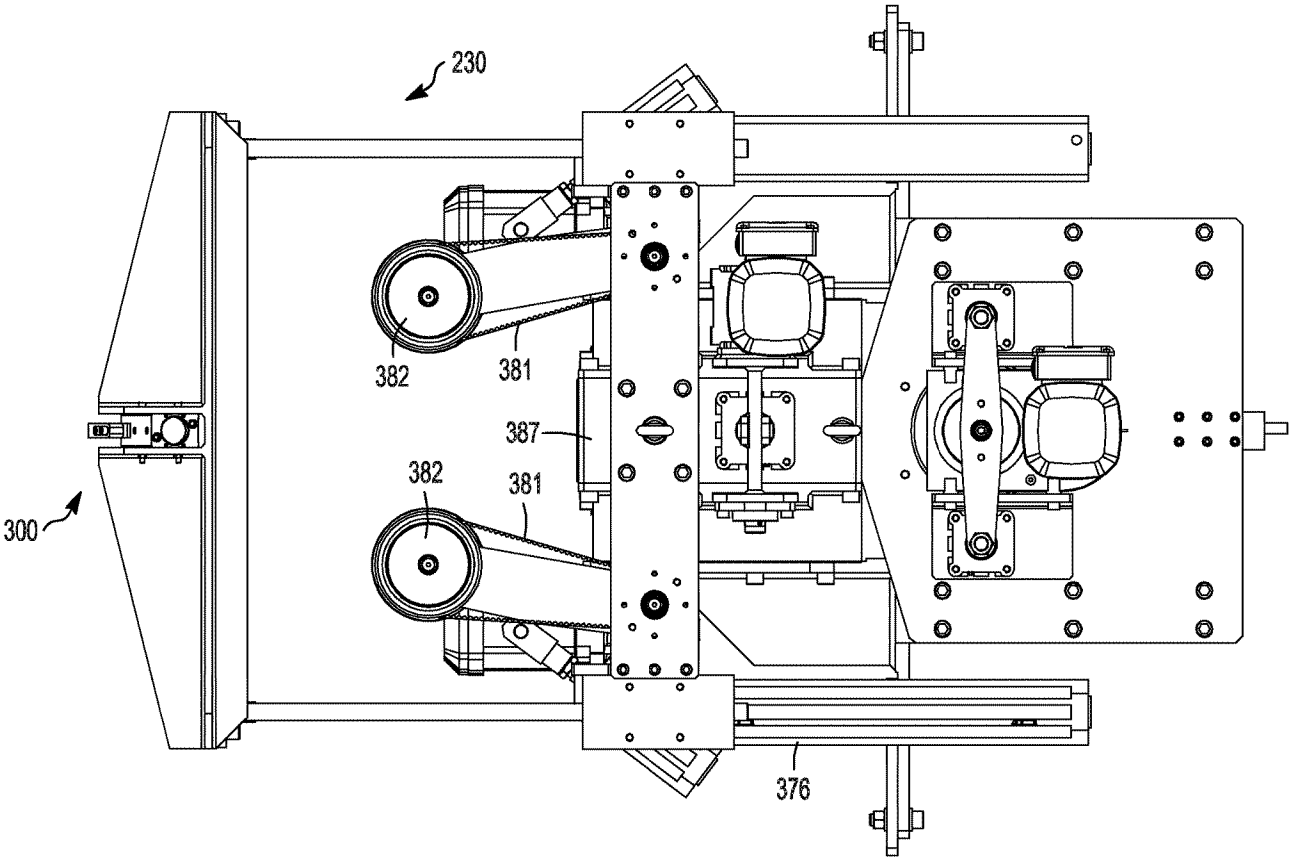
FIG. 22 is a top plan view thereof.
Figure 23:
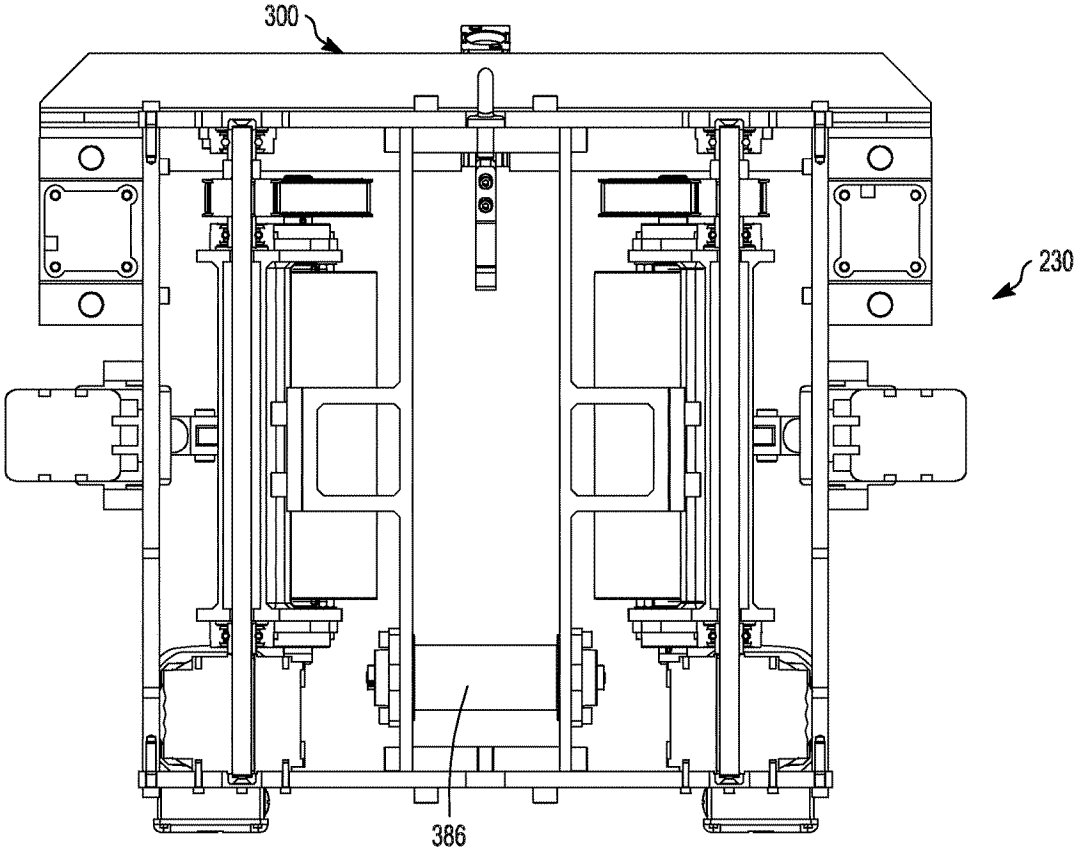
FIG. 23 is a front elevational view thereof.
Figures 24, 25:
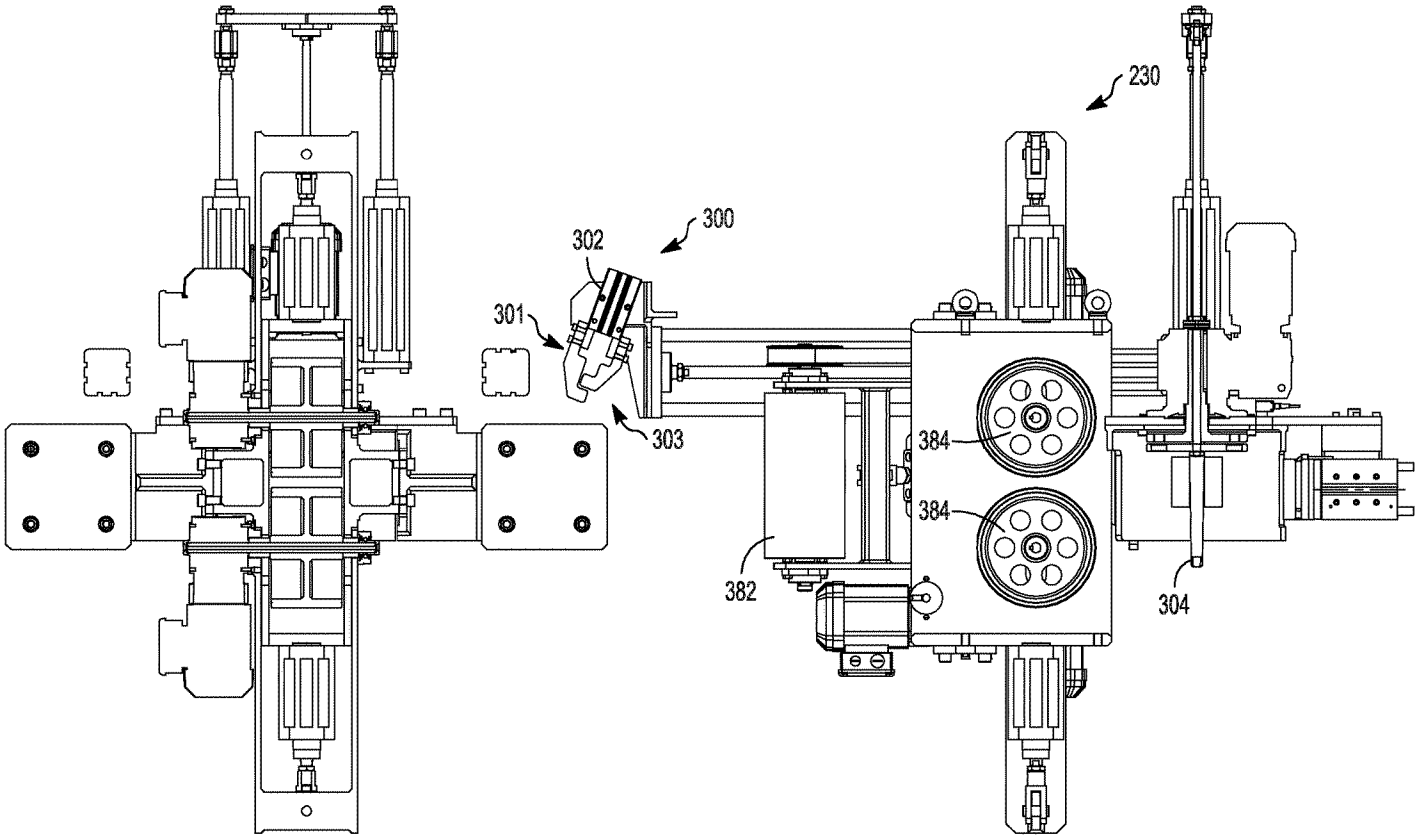
FIG. 24 is a rear sectional view thereof.
FIG. 25 is a sectional side view of the unwrapping machine.

The gripper heads 56 and the bag pinch gripper 100 are simultaneously retracted (i.e. moved outwardly) by the pneumatic actuators 76 and the pneumatic pull back cylinder 103, while the lift motor/transmission assembly 51 is operated to slowly lower the lift conveyor carriage 42—see FIGS. 10 to 12.

The cotton C in the lower portion of the round module 10 is no longer supported by the lift conveyor belt 41, and the four-way stretching of the wrapping W by the gripper heads 56 reduces the frictional contact between the cotton C in the round module 10 and the wrapping W.

The cotton C in the lower portion starts falling free from the roll module 10, and the cotton C is gradually released from the lower portion to the upper portion, until all the cotton C is received on, and supported by, the lift conveyor belt 41 in a heap or pile.

As the bag pinch gripper 100 is retracted, it feeds the engaged portion of the upper rim of the wrapping W into engagement with the (driven) pinch rollers 81 (and over the lower bag guide roller 86) to the compression rollers 84. The wrapping W is drawn away from the centre of the unwrapping machine 30 and is wound onto the vertical wrap spindle 104.

When the entire wrapping W is received on the wrap spindle 104, the RF welding head 106, advances the welding iron 107, to weld the wrapping W into a waste roll R about the wrap spindle 104.

The eject cylinder 108 is extended to transfer the waste roll R to the waste discharge conveyor 109 for transfer to a waste discharge location. (NB: A number of the wrappings W may be formed into a waste roll Ron the wrap spindle 104 before transfer to the waste discharge conveyor 109.)

The skilled addressee will appreciate the waste rolls R can be returned to a plastics manufacturer for recycling of the plastics-material.

When the lift conveyor carriage 42 is in the lowered position, supporting the heap or pile of released cotton C, the lift conveyor belt 41 is operated to transfer the cotton C to the discharge conveyor 90—see FIGS. 6 and 7.

The lift conveyor 40 is ready to receive the next round module 10 to be unwrapped, and the cycle is repeated.

FIGS. 20 to 25 illustrate a second embodiment of the unwrapping machine 230 where the bag pinch gripper 300 has a movable jaw 301, moved by a pneumatic cylinder 302, and co-operates with a fixed jaw, or anvil, 303 to grip the upper rim of the wrapping W, before the bag pinch gripper 300 is retracted by rams 376 to enable the wrapping to be received on the wrap spindle 304.

The wrap W gripped by the bag pinch gripper 300 is guided towards the compression rollers 384 by vertical head rollers 382 driven by belts 381 and over a lower guide belt passing around the guide roller 386. The belts 381 will assist in guiding the wrap W towards the compression rollers 384.

The unwrapping method and apparatus 230 is arranged to direct the wrap W, in a single piece, to the wrapping spindle 304 to ensure none of the wrap W contaminates the cotton released from the module.

The skilled addressee will appreciate the following (but non-exhaustive) list of advantages of the present invention include:

a) the cotton is released from the round modules in a controlled manner;

b) by not cutting the wrapping, the problem of waste plastics contaminating the released cotton is overcome, or at least ameliorated;

c) the plastics-material is positively drawn away from the cotton, and is collected/transported for recycling;

d) the unwrapping machine can be easily integrated with existing feed and discharge conveyors at the cotton gin;

e) the feed conveyor, unwrapping machine and the discharge conveyor can be easily linked, and their respective operations timed/controlled by a master (programmable) control system;

f) the unwrapping machine can be constructed from many off-the-shelf components, at a reduced capital, cost, while providing a robust/reliable machine;

g) the cotton is released into a heap or pile which is easily handled/transported; and h) the system is fully automated and does not require a dedicated operator.

The present invention, as hereinbefore described and illustrated, provides a relatively simple, but safe and highly efficient, method of, and apparatus for, the unwrapping of round modules of cotton or like materials.

Various changes and modifications may be made to the embodiments described and illustrated without departing from the present invention.

The invention claimed is:

1. A method of unwrapping a module of cotton or other fibrous material from a wrapping of at least one layer of sheet material including the steps of:

a) raising the round module to a first, or elevated, position on a lift conveyor or vertically-movable support surface;

b) advancing a plurality of gripper heads, mounted on a support frame, to an advanced position, into gripping engagement with the layer(s) of the sheet material wrapping;

c) lowering the lift conveyor or vertically-movable support surface from the first position towards a second, or lowered, position; and d) retracting the plurality of gripper heads, to expand the wrapping to progressively release the cotton or other fibrous material from the lower portion to the upper portion of the module.

2. The method of claim 1, including the further step of:

e) as, or after, the lower portion of the cotton is being released from the wrapping, the wrapping is engaged by a discharge apparatus on the support frame for delivery to a waste collection site.

3. The method of claim 1, including the further step:

before step a), the wrapped round module is conveyed to a feed side of the lift conveyor with the central axis of the module arranged substantially vertically, when the lift conveyor is in the second position.

4. The method of claim 3, including the further step:

f) the released cotton falls into a heap or pile on the lift conveyor, and is discharged from a discharge side of the lift conveyor when the lift conveyor has returned to the second position.

5. An unwrapping machine for unwrapping at least one layer of sheet material wrapping from a module of cotton or other fibrous material, the machine including:

a support frame;

a lift conveyor or vertically-movable support surface, within the support frame;

a lifting mechanism to selectively move the lift conveyor from a first, or elevated, position to a second, or lowered, position;

a plurality of gripper heads, the gripper heads being mounted on movable support mechanisms; and the support mechanisms are mounted on the support frame and are operable to selectively advance the gripper heads into engagement with the layer(s) of the sheet material wrapping; so arranged that:

as the lifting mechanism lowers the lift conveyor from the first position to the second position, the support mechanisms retract the gripper heads outwardly towards the support frame to cause the wrapping to be expanded to progressively release the cotton from the lower portion to the upper portion of the module onto the lift conveyor.

6. The machine of claim 5, wherein:

a feed conveyor delivers the unwrapped modules to a feed side of the lift conveyor, when the lift conveyor is in the second position; and a discharge conveyor receives the released cotton from a discharge side of the lift conveyor when the lift conveyor has returned to the second position; the feed and discharge sides being on opposed sides of the lift conveyor.

7. The machine of claim 5, wherein:

the lift conveyor has a carriage mounted on substantially-vertical guides on the support frame, the carriage supporting a conveyor belt or conveyor rollers to support the wrapped module and the released cotton; and a drive mechanism for the conveyor belt or conveyor rollers; and the lifting mechanism employs cables and sheaves, or chains and sprockets, or hydraulic- or pneumatic-ram(s), to raise and lower the lift conveyor.

8. The machine of claim 5, wherein:

the support frame has a plurality of posts or columns, where each column supports a respective support mechanism;

each support mechanism incorporates a scissor-arms assembly, or like arrangement, to selectively advance/retract their respective gripper heads in a substantially-vertical orientation; and, each gripper head has a substantially-vertical engagement face or plate, and a plurality of gripper fingers extend there-from to engage the wrapping, the gripper fingers being selectively retractable behind the engagement place to release the wrapping.

9. The machine of claim 5, further including:

a discharge apparatus is provided at, or adjacent, the top of the support frame, and has at least one pair of pinch rollers adapted to engage an upper portion of the wrapping when at least a portion of the cotton has been released from the wrapping, together with a drive mechanism for the pinch rollers.

10. A module of cotton or other fibrous material unwrapped by the method of claim 1.

* * * * *